US011432606B1

(12) United States Patent
Reiter et al.

(10) Patent No.: US 11,432,606 B1
(45) Date of Patent: Sep. 6, 2022

(54) LOCKING MAGNETIC FASTENERS

(71) Applicant: Romag Fasteners, Inc., Milford, CT (US)

(72) Inventors: Howard J. Reiter, Orange, CT (US); Tim Kwok Cheung, Quarry Bay (HK)

(73) Assignee: Romag Fasteners, Inc., Milford, CT (US)

( * ) Notice: Subject to any disclaimer, the term of this patent is extended or adjusted under 35 U.S.C. 154(b) by 20 days.

(21) Appl. No.: 17/212,547

(22) Filed: Mar. 25, 2021

(51) Int. Cl.
*A41F 1/00* (2006.01)
*A44B 17/00* (2006.01)

(52) U.S. Cl.
CPC ..... *A41F 1/002* (2013.01); *A44B 17/0041* (2013.01); *A44D 2201/10* (2013.01); *A44D 2203/00* (2013.01)

(58) Field of Classification Search
CPC . A41F 1/002; A44B 17/0041; A45C 13/1069; Y10T 24/32; A44D 2201/00; A44D 2203/00
See application file for complete search history.

(56) References Cited

U.S. PATENT DOCUMENTS 5,042,116 A 8/1991 Ossiani
5,722,126 A 3/1998 Reiter
5,868,445 A * 2/1999 Kaufman ..... A45C 13/1069 292/42
6,295,702 B1 * 10/2001 Bauer ..... A45C 13/1069 24/303
8,650,723 B2 2/2014 Reiter
10,047,774 B2 8/2018 Yeung et al.
2016/0363142 A1 * 12/2016 Yeung ..... F16B 7/0426

* cited by examiner

*Primary Examiner* — Robert Sandy
(74) *Attorney, Agent, or Firm* — Wolf, Greenfield & Sacks, P.C.

(57) ABSTRACT

Embodiments disclosed herein relate to magnetic fasteners capable of transitioning between a locked state and an unlocked state. In some embodiments, the magnetic fastener includes a first fastening portion and a second fastening portion configured to interface with one another. The first fastening portion may include a first pin with a channel configured to receive a second pin disposed on the second fastening portion. The channel may include a recess and the second pin may include a projection complementary to the recess such that the projection may be disposed within the recess when the respective central axes of the first and second fastening portions are offset. Thus, a portion of the recess may abut the projection when the respective central axes of the first and second fastening portions are offset, thus locking the first and second fastening portions relative to one another. Conversely, when the respective central axes of the first and second fastening portions are aligned, the projection may not be disposed within the recess, and accordingly, the first and second fastening portions may be capable of being unfastened from one another.

21 Claims, 7 Drawing Sheets

LOCKING MAGNETIC FASTENERS

FIELD

Disclosed embodiments relate to locking magnetic fasteners, for example, for securing a first material to a second material.

BACKGROUND

Mechanical and magnetic snap fasteners may be commonly used to attach one material to another in articles such as clothing, bags, purses, shoes, and the like. Mechanical snap fasteners typically consist of a male component comprising a cylindrical stud having an enlarged tip and a female component comprising a socket having a retaining feature, which may engage with the enlarged tip of the stud. The male and female components may be attached to different materials desired to be attached to one another.

In a typical magnetic snap fastener, a female component with a magnet may be attached to a first material and a male component attracted to the magnet may be attached to a second material. The two components may be magnetically attracted to one another and releasably fasten the materials together.

BRIEF SUMMARY

According to one aspect, a magnetic fastener for releasably coupling a first material to a second material, the fastener includes a first fastening portion configured to be fixed to the first material, the first fastening portion including a first pin having a channel, wherein at least a portion of the first pin is formed from a ferromagnetic material; a second fastening portion configured to be fixed to the second material, the second fastening portion including an annular opening configured to receive the first pin and a second pin disposed within the annular opening shaped to fit within the channel of the first pin, wherein the second fastening portion includes a magnetic ring disposed within a body of the second fastening portion; wherein the channel includes a recess and the second pin includes a projection associated with the recess such that when a central axis of the channel is aligned with a central axis of the second pin, the second pin is insertable and removable from the channel; wherein when the central axis of the channel is offset from the central axis of the second pin, the second pin is prevented from being inserted and removed from the channel; and wherein the first and second fastening portions are configured to magnetically couple the first and second materials.

According to another aspect, a magnetic fastener for releasably coupling a first material to a second material, the fastener includes a first fastening portion configured to be fixed to the first material, the first fastening portion including a first pin having a channel, wherein at least a portion of the first pin is formed from a ferromagnetic material; a second fastening portion configured to be fixed to the second material, the second fastening portion including an annular opening configured to receive the first pin and a second pin disposed within the annular opening shaped to fit within the channel of the first pin, wherein the second fastening portion includes a magnetic ring disposed within a body of the second fastening portion; wherein the channel includes a recess and the second pin includes a projection associated with the recess; wherein when the second pin is inserted into the channel of the first pin and when a central axis of the channel is offset from a central axis of the second pin, a portion of the projection abuts a portion of the recess, preventing the second pin from being removed from the channel; and wherein the first and second fastening portions are configured to magnetically couple the first and second materials.

According to another aspect, a male magnetic fastening portion configured to be fixed to a material includes a body; a pin formed with or fixed to the body configured to interface with a complementary female magnetic fastening portion, wherein the pin is at least partially formed from a ferromagnetic material; a channel formed within the pin; and a recess formed within the channel configured such that when the pin is interfaced with the complementary female magnetic fastening portion and when a central axis of the channel is offset from a central axis of the complementary female magnetic fastening portion, the male magnetic fastening portion is locked to the complementary female magnetic fastening portion.

According to another aspect, a female magnetic fastening portion configured to be fixed to a material includes a body including a magnetic ring; an annular opening formed within the body configured to interface with a complementary male magnetic fastening portion having a first pin with a channel and a recess formed within the channel; a second pin disposed within the annular opening; and a projection extending from the second pin configured such that when the annular opening is interfaced with the complementary male magnetic fastening portion and when a central axis of the second pin is offset from a central axis of the complementary male magnetic fastening portion, the female magnetic fastening portion is locked to the complementary male magnetic fastening portion.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

Non-limiting embodiments of the present invention will be described by way of example with reference to the accompanying figures, which are schematic and are not intended to be drawn to scale. In the figures, each identical or nearly identical component illustrated is typically represented by a single numeral. For purposes of clarity, not every component is labeled in every figure, nor is every component of each embodiment of the invention shown where illustration is not necessary to allow those of ordinary skill in the art to understand the invention. In the figures.

DETAILED DESCRIPTION

Figure 1:
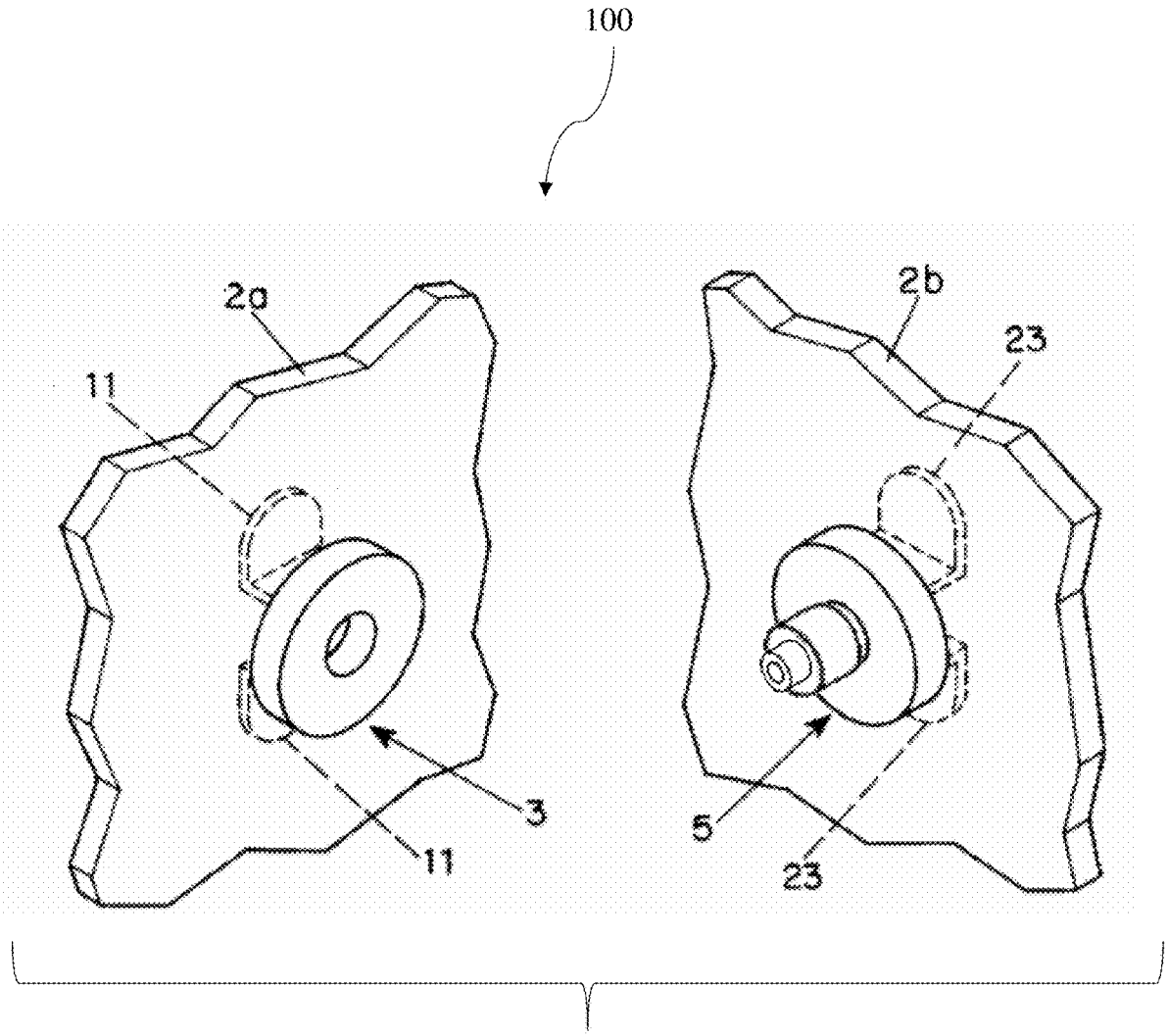
FIG. 1 is a perspective view of a locking magnetic fastener applied to pieces of material according to one illustrative embodiment.

Typically, conventional fasteners, such as magnetic fasteners may be employed to attach a first material to a second material. Typically, the fastener may include a first fastening portion (e.g., a male portion) and a second fastening portion (e.g., a female portion), which interface with one another to releasably couple. However, in some instances, it may be desirable for the first fastening portion and the second fastening portion to lock relative to one another when a central axis of the first fastening portion is offset from a complementary central axis of the second fastening portion, for example to secure a handbag or other suitable article. A conventional fastener may not be capable of such functionality.

In view of the above, the Inventor has recognized the advantages of a magnetic fastener capable of transitioning between a locked state (e.g., when a central axis of the first fastening portion is offset from a complementary central axis of the second fastening portion) and an unlocked state (e.g., when a central axis of the first fastening portion is aligned with a complementary central axis of the second fastening portion).

In some embodiments, a magnetic fastener includes a first fastening portion and a second fastening portion, which are configured to releasably attach to one another. In turn, the first fastening portion may be attached to a first section of material and the second fastening portion may be attached to a second material. Thus, a user may releasably attach the first section of material to the second section of material via the first and second fastening portions.

Moreover, the first and second fastening portions may include features that allow the first and second fastening portions to lock relative to one another when their respective central axes are offset. For example, the first fastening portion may include a first pin having an at least partially hollow channel for interfacing with the second fastening portion (e.g., via magnetic attraction). In turn, the second fastening portion may include an annular opening for receiving the first pin. Within the annular opening, the second fastening portion may further include a second pin, which may be inserted and/or removed from the channel of the first pin.

Relatedly, the channel of the first pin may include a recess and the second pin may include a projection complementary to the recess such that when the second pin is inserted into the channel of the first pin and the central axis of the channel is offset from the central axis of the second pin, a portion of the projection is disposed within the recess. Accordingly, a portion of the recess may abut a portion of the projection when the respective central axes of the first and second fastening portions are offset, preventing the second pin from being removed from the channel. Conversely, when the central axes of the first and second fastening portions are aligned, the projection may not be disposed within the recess (e.g., the projection may instead be disposed within the body of the channel), allowing the first and second fastening portions to be removed from one another.

Thus, the first and second fastening portions may lock relative to one another when their respective central axes are offset.

Turning to the figures, specific non-limiting embodiments are described in further detail. It should be understood that the various systems, components, features, and methods described relative to these embodiments may be used either individually and/or in any desired combination as the disclosure is not limited to only the specific embodiments described herein.

Figure 5:
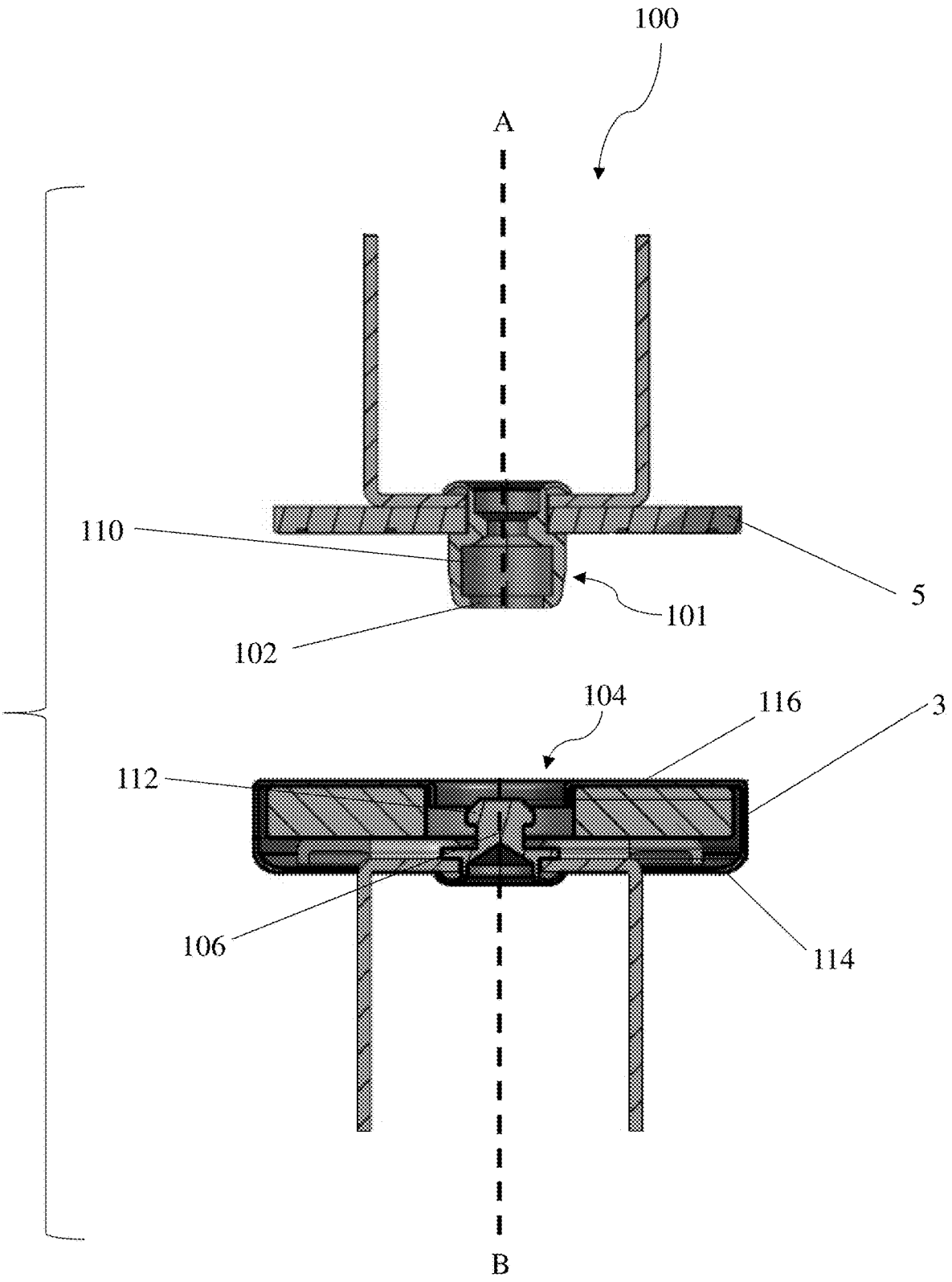
FIG. 5 is a cross sectional view of a first and second fastening portion in an unfastened state taken along line 5-5 according to the embodiment of FIG. 4.

As shown in FIG. 1, a magnetic fastener 100 according to some embodiments of the present disclosure includes a female fastening portion 3 and a male fastening portion 5 that are initially separated from one another (e.g., in an unfastened state). Female fastening portion 3 and male fastening portion 5 may be configured to attach to one another (e.g., in a fastened state). For example, female and male fastening portions 3, 5 may attach to one another via a magnetic field. In some embodiments, female fastening portion 3 includes a magnetic ring 114 (e.g., as shown in FIG. 5), which may be toroidal in shape. Accordingly, magnetic ring 114 may produce a magnetic field, which may be configured to interface with a ferromagnetic material. In turn, male fastening portion 5 may include a pin 101, at least a portion of which is formed from a ferromagnetic material. When the ferromagnetic portion of pin 101 is placed within the toroidal magnetic ring 114, pin 101 and magnetic ring 114 form a magnetic circuit. Thus, the force of magnetic ring 114 may serve to snap male fastening portion 5 and female fastening portion 3 together when a user approximates female and male fastening portions 3, 5. Further, the force of magnetic ring 114 may serve to hold female fastening portion 3 and male fastening portion 5 in a fastened state until the user pulls female and male fastening portions 3, 5 apart.

Magnetic ring 114 may be held within the body of female fastening portion 3 via a non-magnetic cover 116. In some embodiments, non-magnetic cover 116 may be made of brass, for example to enhance the appearance of the fastener. Of course, non-magnetic cover 116 may be made of other suitable materials, depending on the application.

Both female fastening portion 3 and male fastening portion 5 may each include one or more legs 11, 23. Legs 11, 23, may serve to attach the fastening portions to sections of material. For example, as shown in FIG. 1, legs 11 may serve to attach female fastening portion 3 to a first segment of material 2*a*, and legs 23 may serve to attach male fastening portion 5 to a second segment of material 2*b*. Thus, when female fastening portion 3 and male fastening portion 5 are fastened to one another (e.g., as described above), first segment of material 2*a* may be attached to second segment of material 2*b*. In some embodiments, legs 11, 23 may be non-rigidly attached to female and male fastening portions 3, 5 respectively. For example, in some instances, legs 11, 23 may be free to rotate relative to the respective bodies of female and male fastening portions 3, 5.

Of course, female fastening portion 3 and male fastening portion 5 may alternatively employ other means for attaching to first and second segments of material 2*a*, 2*b*. In some embodiments, female fastening portion 3 and male fastening portion 5 alternatively employ rolled rivets or Kwik-rivet connectors, though any other suitable attachment means may be employed, depending on the application.

Figure 2:
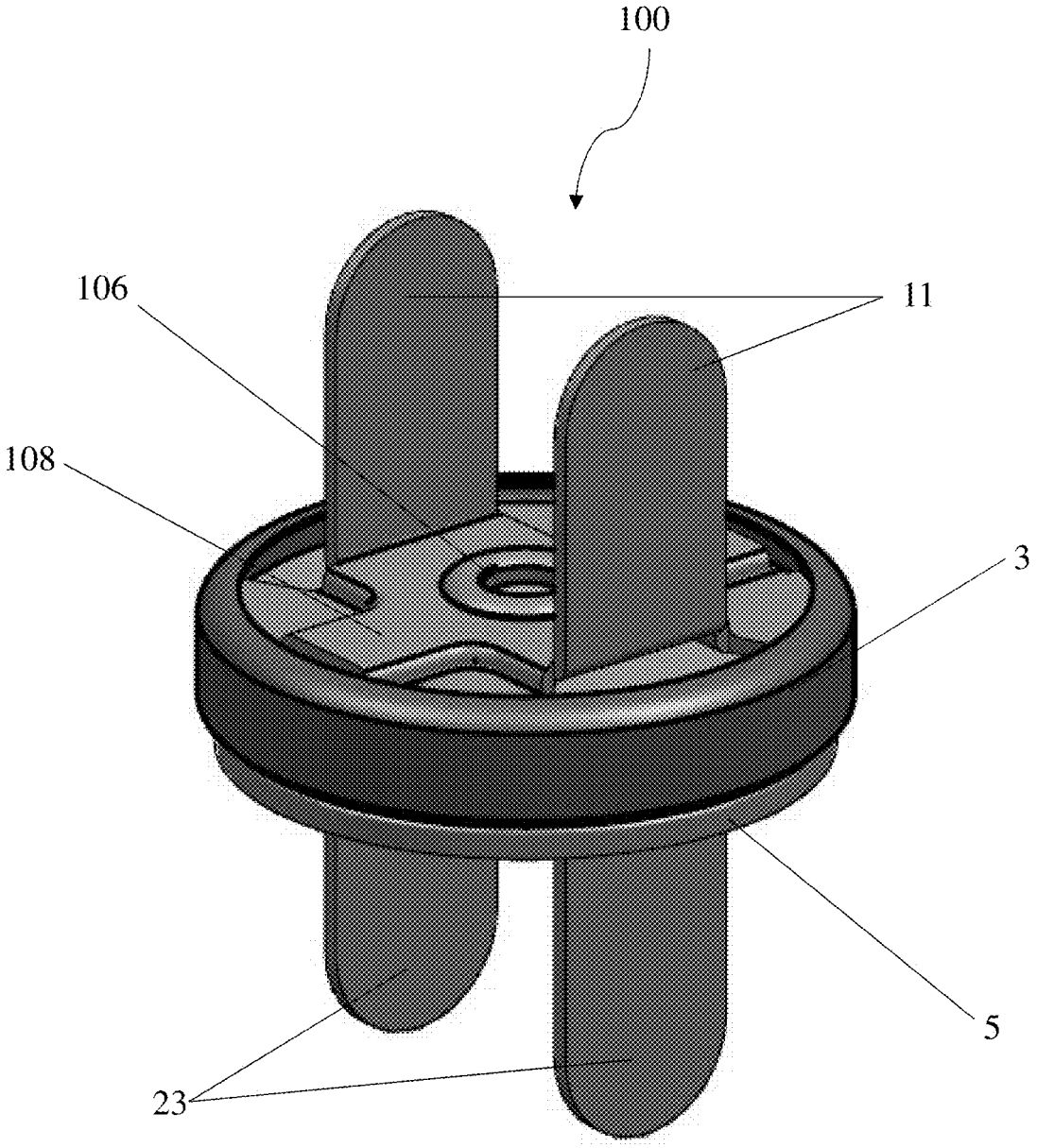
FIG. 2 is a perspective view of a locking magnetic fastener according to one illustrative embodiment.

FIG. 2 shows a perspective view of magnetic fastener 100 where female and male fastening portions 3, 5 are fastened to one another. In some embodiments, legs 11 may be formed with or attached to a bracket 108. Bracket 108 may be attached to female fastening portion 3 via second pin 106. For example, in some embodiments (e.g., the embodiment of FIG. 2), a portion of second pin 106 may be rolled over bracket 108 to fix bracket 108 to female fastening portion 3. Accordingly, legs 11 may be free to rotate relative to the body of female fastening portion 3 (e.g., as described above).

Of course, legs 11 and/or bracket 108 may be attached to the body of female fastening portion 3 in any suitable manner. For example, in some embodiments, legs 11 may be formed with the body of female fastening portion 3 (e.g., legs 11 and/or bracket 108 may be stamped out of a single back plate of female portion 3). Alternatively, legs 11 and/or bracket 108 may be attached to the body of female portion 3 via welding. Other manners of attaching legs 11 and/or bracket 108 to the body of female fastening portion 3 may be employed, depending on the application.

Correspondingly, legs 23 may be attached to the body of male fastening portion 5 in a similar manner (e.g., the manners described above for legs 11 and female fastening portion 3). In some embodiments, legs 23 are attached to the body of male fastening portion in the same manner that legs 11 are attached to the body of female fastening portion 3, though this need not be the case. For example, in some instances, legs 11 may be attached to female fastening portion 3 in a manner that allows legs 11 to rotate relative to the body of female fastening portion 3, while legs 23 may be attached to the body of male fastening portion 5 in a manner that holds legs 11 fixed relative to the body of male fastening portion 5. The opposite may also be true. For example, in some instances, legs 11 may be attached to female fastening portion 3 in a manner that holds legs 11 fixed relative to the body of female fastening portion 3, while legs 23 may be attached to the body of male fastening portion 5 in a manner that allows legs 11 to rotate relative to the body of male fastening portion 5. Of course, any suitable combination of manners of fastening legs 11, 23 to the respective bodies of female and male fasteners 3, 5 may be employed, depending on the application.

Figure 3A:
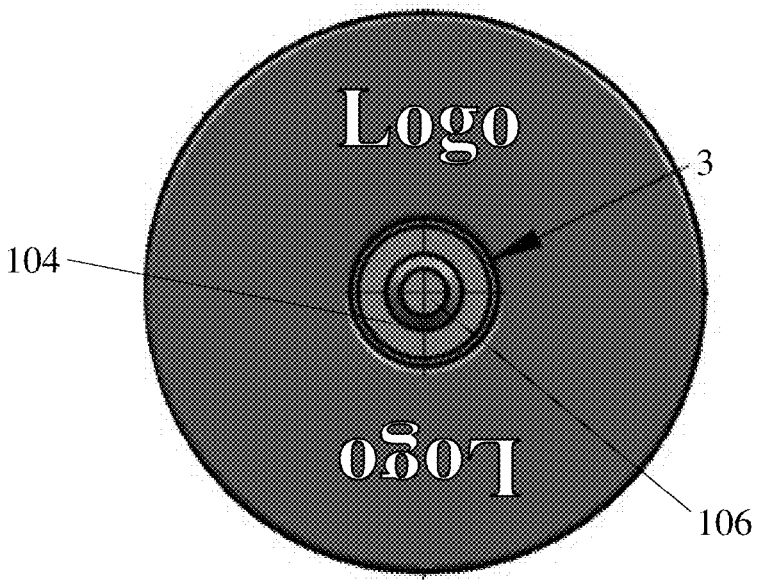
FIG. 3*a* is a top view of a first fastening portion of a locking magnetic fastener according to one illustrative embodiment.
Figure 3B:
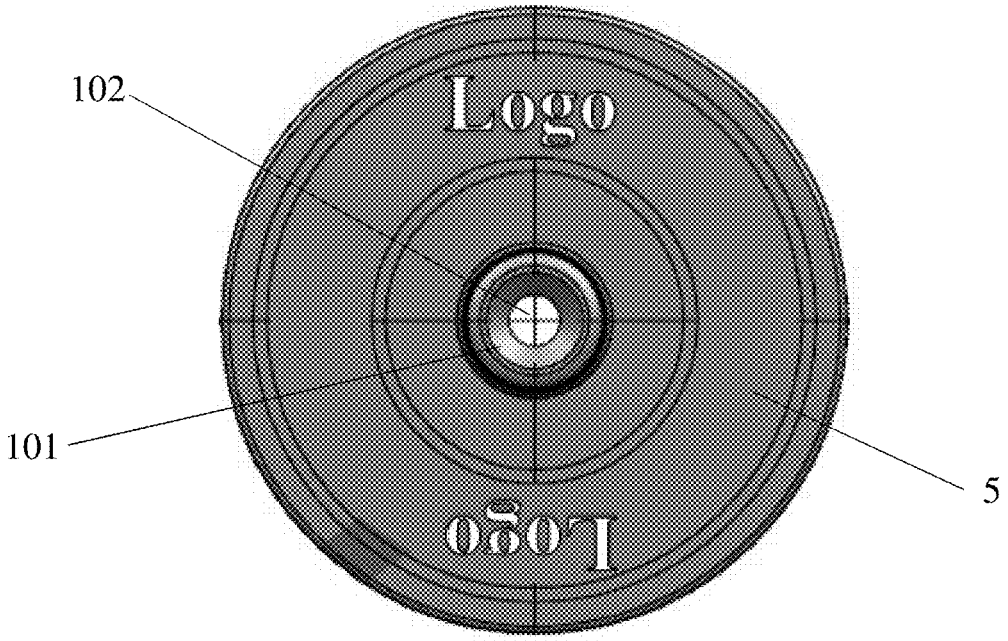
FIG. 3*b* is a top view of a second fastening portion of a locking magnetic fastener according to one illustrative embodiment.

As shown in FIGS. 3*a*, and 3*b* magnetic fastener 100 may include features to ensure alignment between female and male fasteners 3, 5 when a user attaches female and male fasteners 3, 5 to one another. For example, in some embodiments, male fastener 5 includes a first pin 101 having a channel 102. Correspondingly, female fastener 3 may include an annular opening 104 of a size and shape complementary to that of first pin 101. Female fastener 3 may further include a second pin 106 sized and shaped to fit within channel 102 of first pin 101. Thus, as a user approximates the female and male portions 3, 5, the user must align second pin 106 with channel 102 and first pin 101 with annular opening 104 to fasten female and male fasteners 3, 5 to one another.

First pin 101, channel 102, annular opening 104, and second pin 106 may each be formed in any suitable set of complementary shapes. For example, in some embodiments (e.g., the embodiments of 3*a*, and 3*b*), channel 102 may be cylindrical. Correspondingly, second pin 106 may also be generally cylindrical so as to fit within channel 102. It follows that in such an embodiment, the body of pin 101 and annular opening 104 would be generally cylindrically shaped. Of course, other shapes are also contemplated, including shapes with generally triangular cross sections, generally rectangular cross sections, or generally square cross sections. Other appropriate shapes or combinations of shapes may be employed, depending on the application.

Also, as shown in FIGS. 3*a* and 3*b*, male and/or female fastening portions 3, 5 may include branding, a logo, or any other suitable marking. The branding, logo, or other suitable marking may be attached to male and/or female fastening portions 3, 5 (e.g., using one or more stickers or other suitable medium). Alternatively or additionally, the branding, logo, or other suitable marking may be formed with male and/or female fastening portions 3, 5 (e.g., via stamping or embossing). Of course, in some instances, male and/or female fastening portions 3, 5 may not include branding, a logo, or any other suitable marking, depending on the application.

Figure 4:
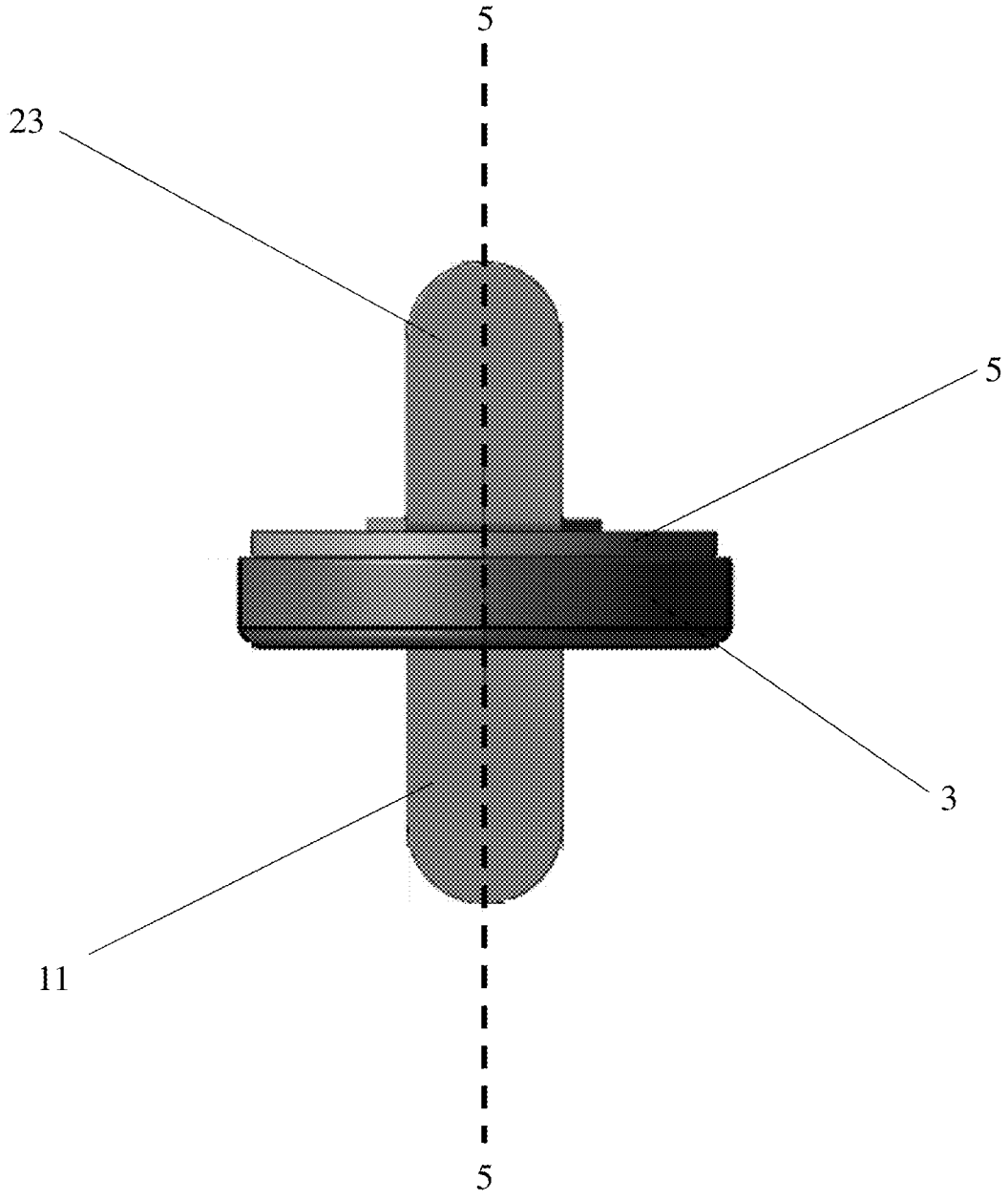
FIG. 4 is an elevation view of a locking magnetic fastener comprising a first and second fastening portion according to one illustrative embodiment.
Figure 6:
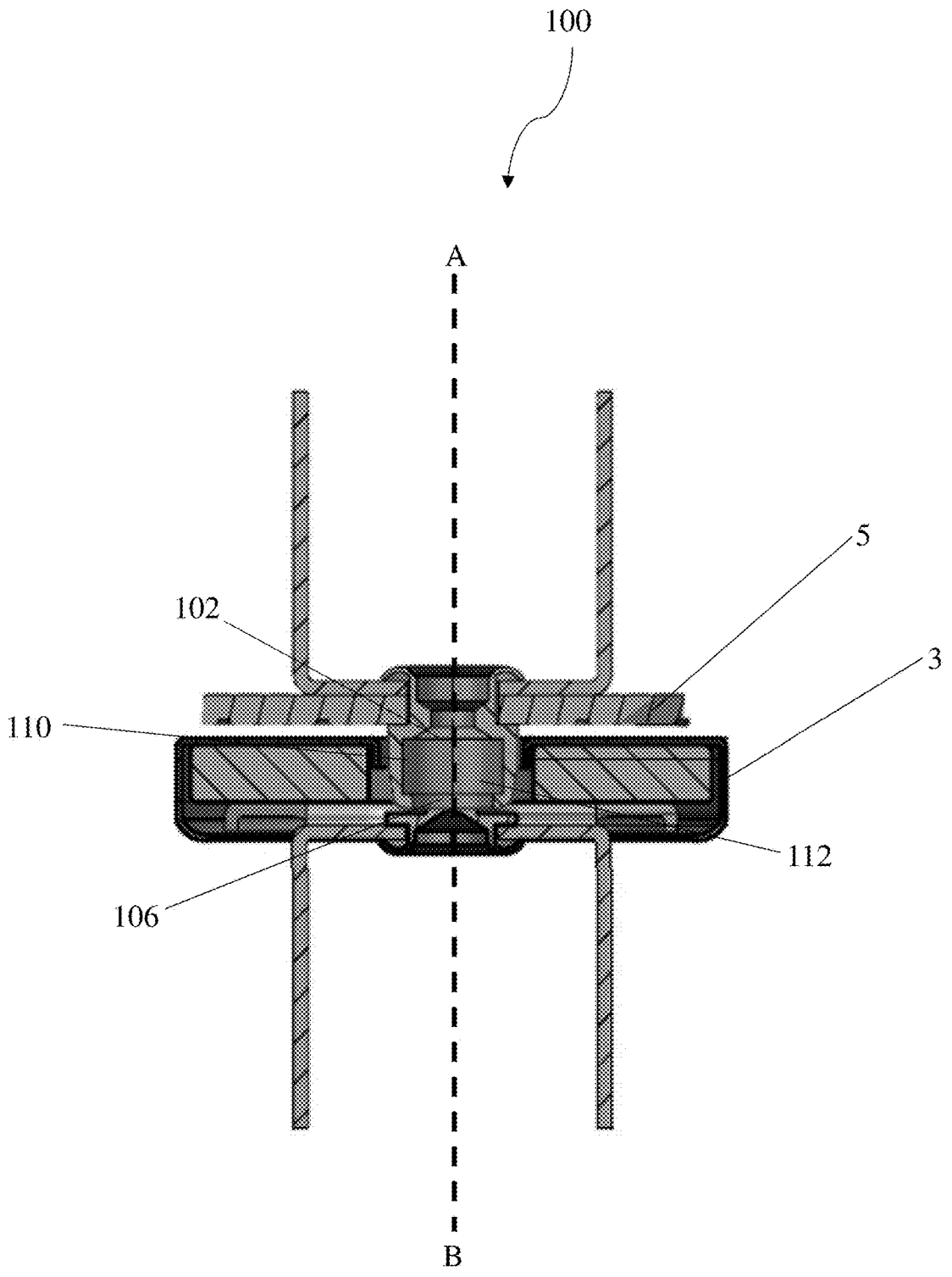
FIG. 6 is a cross sectional view of a first and second fastening portion in a first fastened state taken along line 5-5 according to the embodiment of FIG. 4.
Figure 7:
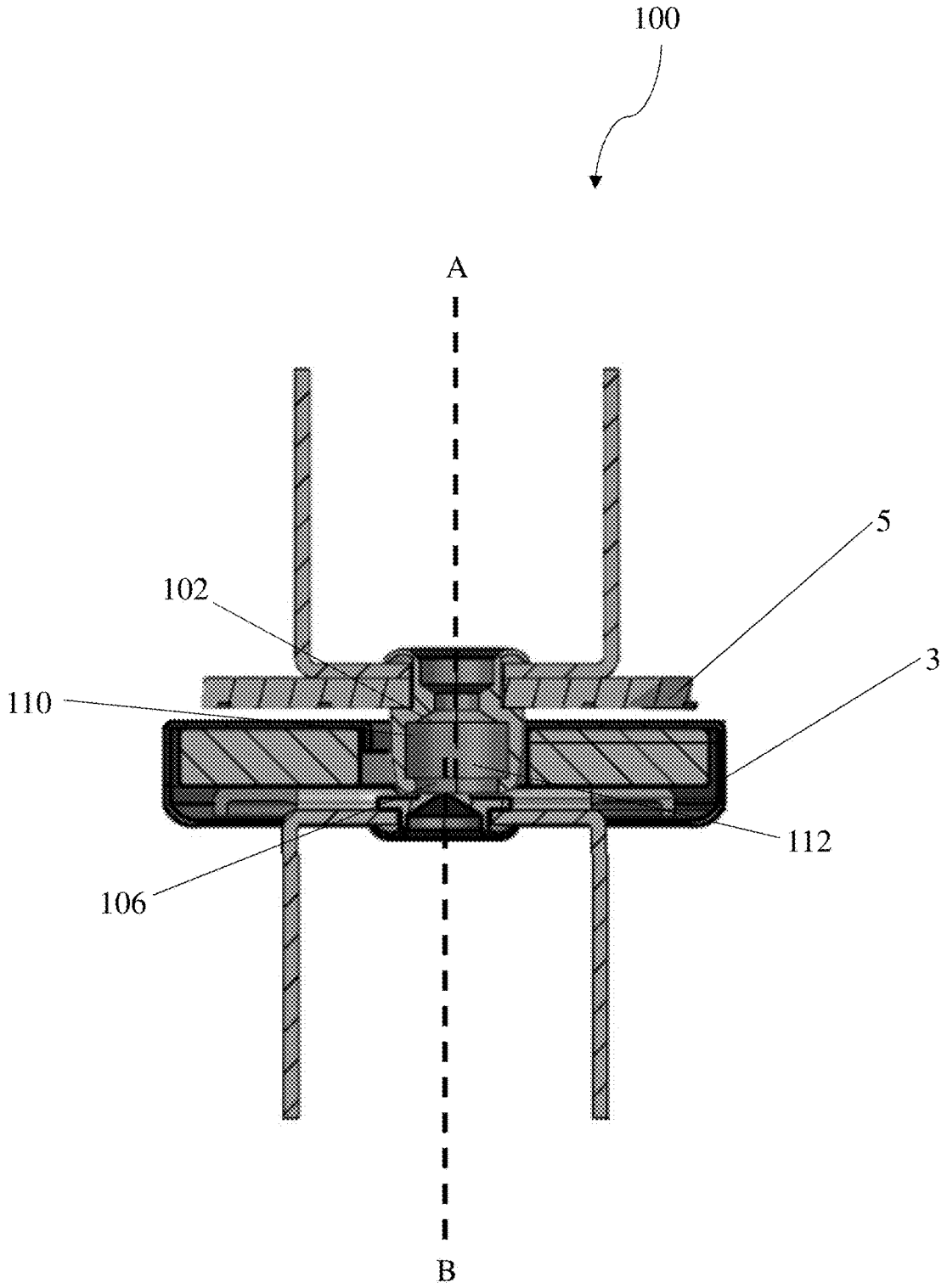
FIG. 7 is a cross sectional view of a first and second fastening portion in a second fastened state taken along line 5-5 according to the embodiment of FIG. 4.

In some embodiments, the magnetic fastener 100 may include features that allow female and male fastening portions 3, 5 to lock relative to one another when female and male fastening portions 3, 5 are fastened to one another and the respective central axes of female and male fastening portions 3, 5 are offset, for example, as shown in FIGS. 5-7. FIGS. 5-7 show cross sectional views of magnetic fastener 100, taken along line 5-5 of FIG. 4 in three different states: an unfastened state, a fastened but unlocked state, and a fastened and locked state, as described in greater detail below. Particularly, FIG. 5 shows a cross sectional view of male fastening portion 5 and female fastening portion 3 in an unfastened state. As described above, in some embodiments, in order to fasten male fastening portion 5 to female fastening portion 3, a user may need to align a central axis A of male fastening portion 5 with a central axis B of female fastening portion 3. When axis A and axis B are aligned, channel 102 may be able to fit over second pin 106. In some embodiments, pin 106 may also include a projection 112 extending around a perimeter of the body of second pin 106, which may be configured to fit within channel 102 when axis A and axis B are aligned. Moreover, when axis A and axis B are out of alignment, projection 112 and or second pin 106 may prevent second pin 106 from fitting within channel 102, preventing female and male fastening portions 3, 5 from fastening to one another.

To achieve such functionality, a transverse dimension of projection 112 may be smaller than or approximately equal to in size to a transverse dimension channel 102. For example, in some embodiments, channel 102 is cylindrical (e.g., as described above). In such embodiments, projection 112 has a generally circular cross section. Accordingly, in such embodiments, the transverse dimensions of channel 102 and projection 112 are the respective diameters of channel 102 and projection 112. Thus, in order to fit within channel 102, the diameter of projection 112 may be smaller than or approximately equal to the diameter of channel 102. Of course, projection 112 may be formed with other suitable types of cross sections including generally triangular cross sections, generally rectangular cross sections, generally square cross sections. Of course, projection 112 may be shaped in any suitable manner, depending on the application.

In some embodiments, for example the embodiment shown in FIGS. 5-7, once axis A and axis B are aligned, a user may fasten female and male fastening portions 3, 5 to one another, as described above. After female and male portions 3, 5 are attached to one another, magnetic fastener 100 may enter a first fastened state (e.g., unlocked) as shown in FIG. 6. In the first fastened state, female and male fastening portions of 3, 5 may be fastened to one another (e.g., magnetically as described above). However, in this state, magnetic fastener 100 may be unlocked, meaning that a user may separate female and male fastening portions of 3, 5 (e.g., by pulling female and male fastening portion 3, 5 apart) because axis A and axis B are aligned in the first fastened state. For example, pin 106 may exit channel 102 in the same manner that pin 106 entered channel 102.

However, in some embodiments, when female and male portions 3, 5 are attached to one another, axis A and axis B may become offset from one another, as shown in FIG. 7. In such instances, magnetic fastener 10 may transition to a second fastened state, wherein female and male fastening portion 3, 5 are locked relative to one another. For example, in such a state, projection 112 may be disposed within a recess 110 of channel 102. In such a configuration, at least a portion of recess 110 may abut at least a portion of projection 112. Accordingly, if a user attempts to unfasten female and male fastening portions 3, 5, the abutment between at least a portion of recess 110 and least a portion of projection 112 may prevent female and male fastening portions 3, 5 from unfastening. Thus, in such a state, female and male fastening portions 3, 5 may be locked relative to one another.

Recess 110 may be configured to accommodate projection 112 when female and male portions 3, 5 are attached to one another, and axis A and axis B are offset. Accordingly, the recess may be of a shape complementary to the shape of projection 112. For example, as described above, in some embodiments, projection 112 is generally circular. In such embodiments, recess 110 may be cylindrical. Alternatively, recess 110 may be configured with generally triangular cross sections, generally rectangular cross sections, or generally square cross sections, as appropriate. Of course, any suitable combination of shapes may be employed, depending on the application.

To accommodate projection 112, recess 110 may be configured with a transverse dimension greater than the transverse dimension of projection 112. For example, in embodiments where recess 110 is generally cylindrical and projection 112 has a generally circular cross section, the diameter of recess 110 may be greater than the diameter of projection 112.

Further, recess 110 may be configured with a transverse dimension greater than the transverse dimension of channel 102. Particularly, in instances where both recess 110 and channel 102 are generally cylindrical, the diameter of recess 110 may be greater than the diameter of channel 102.

Magnetic fastener 100 may be capable of transitioning from the first fastened state (e.g., unlocked) to the second fastened state (e.g., locked) when axis A and axis B are offset in any suitable manner. In some embodiments, magnetic fastener 100 may transition from the first fastened state (e.g., unlocked) to the second fastened state (e.g., locked) when axis A and B are offset in one direction. In some embodiments, magnetic fastener 100 may transition from the first fastened state (e.g., unlocked) to the second fastened state (e.g., locked) when axis A and B are offset in at least one of two directions (e.g., a first direction and a second direction perpendicular to the first direction). In some embodiments, magnetic fastener 100 may transition from the first fastened state (e.g., unlocked) to the second fastened state (e.g., locked) when axis A and B are offset simultaneously in multiple directions (e.g., a first component in a first direction and a second component in a second direction perpendicular to the first direction). Of course, magnetic fastener 100 may transition from the first fastened state (e.g., unlocked) to the second fastened state (e.g., locked) when axis A and B are offset in any suitable manner, depending on the application.

Various aspects of the present disclosure may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

The embodiments described herein may be embodied as a method. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Further, some actions are described as taken by a "user." It should be appreciated that a "user" need not be a single individual, and that in some embodiments, actions attributable to a "user" may be performed by a team of individuals and/or an individual in combination with computer-assisted tools or other mechanisms.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. A magnetic fastener for releasably coupling a first material to a second material, the fastener comprising:

a first fastening portion configured to be fixed to the first material, the first fastening portion including a first pin having a channel, wherein at least a portion of the first pin is formed from a ferromagnetic material;

a second fastening portion configured to be fixed to the second material, the second fastening portion including an annular opening configured to receive the first pin and a second pin disposed within the annular opening shaped to fit within the channel of the first pin, wherein the second fastening portion includes a magnetic ring disposed within a body of the second fastening portion;

wherein the channel includes a recess and the second pin includes a projection associated with the recess such that when a central axis of the channel is aligned with a central axis of the second pin, the second pin is insertable and removable from the channel;

wherein when the central axis of the channel is offset from the central axis of the second pin, the second pin is prevented from being inserted and removed from the channel; and wherein the first and second fastening portions are configured to magnetically couple the first and second materials.

2. The magnetic fastener of claim 1, wherein a portion of the recess abuts a portion of the projection when the central axis of the channel is offset from the central axis of the second pin.

3. The magnetic fastener of claim 2, wherein the portion of the recess abuts the portion of the projection when the central axis of the channel is offset from the central axis of the second pin in at least one direction.

4. The magnetic fastener of claim 3, wherein the portion of the recess abuts the portion of the projection when the central axis of the channel is offset from the central axis of the second pin in at least one of two or more directions.

5. The magnetic fastener of claim 1, wherein the projection extends about a perimeter of the second pin.

6. The magnetic fastener of claim 1, wherein the channel is a cylindrical channel.

7. The magnetic fastener of claim 6, wherein the recess is a cylindrical recess.

8. The magnetic fastener of claim 7, wherein the projection is a generally circular shape.

9. The magnetic fastener of claim 8, wherein a diameter of the projection is smaller than a diameter of the channel.

10. The magnetic fastener of claim 9, wherein the diameter of the projection is smaller than a diameter of the recess.

11. The magnetic fastener of claim 10, wherein the diameter of the channel is smaller than the diameter of the recess.

12. A magnetic fastener for releasably coupling a first material to a second material, the fastener comprising:

a first fastening portion configured to be fixed to the first material, the first fastening portion including a first pin having a channel, wherein at least a portion of the first pin is formed from a ferromagnetic material;

a second fastening portion configured to be fixed to the second material, the second fastening portion including an annular opening configured to receive the first pin and a second pin disposed within the annular opening shaped to fit within the channel of the first pin, wherein the second fastening portion includes a magnetic ring disposed within a body of the second fastening portion;

wherein the channel includes a recess and the second pin includes a projection associated with the recess;

wherein when the second pin is inserted into the channel of the first pin and when a central axis of the channel is offset from a central axis of the second pin, a portion of the projection abuts a portion of the recess, preventing the second pin from being removed from the channel; and wherein the first and second fastening portions are configured to magnetically couple the first and second materials.

13. The magnetic fastener of claim 12, wherein the portion of the recess abuts the portion of the projection when the central axis of the channel is offset from the central axis of the second pin in at least one direction.

14. The magnetic fastener of claim 13, wherein the portion of the recess abuts the portion of the projection when the central axis of the channel is offset from the central axis of the second pin in at least one of two or more directions.

15. The magnetic fastener of claim 12, wherein the projection extends about a perimeter of the second pin.

16. The magnetic fastener of claim 12, wherein the channel is a cylindrical channel.

17. The magnetic fastener of claim 16, wherein the recess is a cylindrical recess.

18. The magnetic fastener of claim 17, wherein the projection is a generally circular shape.

19. The magnetic fastener of claim 18, wherein a diameter of the projection is smaller than a diameter of the channel.

20. The magnetic fastener of claim 19, wherein the diameter of the projection is smaller than a diameter of the recess.

21. The magnetic fastener of claim 20, wherein the diameter of the channel is smaller than the diameter of the recess.

* * * * *